US005715755A

United States Patent [19]

Jonischkeit et al.

[11] Patent Number: 5,715,755

[45] Date of Patent: Feb. 10, 1998

[54] TRAVELING CARRIAGE

[75] Inventors: Michael Jonischkeit, Grafing; Karl Maslo, Grasbrunn/Neu Keferloh, both of Germany

[73] Assignee: Sachtler Aktiengesellschaft-Kommunikationstechnik-, Unterschleissheim, Germany

[21] Appl. No.: 519,392

[22] Filed: Aug. 25, 1995

[30] Foreign Application Priority Data

Aug. 31, 1994 [DE] Germany ..... 44 30 984.8

[51] Int. Cl.[6] ..... B61B 3/00

[52] U.S. Cl. ..... 104/93; 105/150; 105/153; 188/42

[58] Field of Search ..... 104/89, 93, 138.1; 105/148, 150, 153; 362/67, 285, 288; 188/35, 38, 42; 292/240, 242, 224

[56] References Cited

U.S. PATENT DOCUMENTS

| | | | |
|---|---|---|---|
| 1,087,773 | 2/1914 | Johnson | 104/246 |
| 1,440,721 | 1/1923 | DiCarlo | 105/153 |
| 3,696,890 | 10/1972 | Armstrong | 104/93 |
| 3,936,906 | 2/1976 | Takazawa | 188/42 |
| 4,741,272 | 5/1988 | Tarassoff | 104/173.1 |
| 4,767,091 | 8/1988 | Cuny | 182/3 |
| 4,957,047 | 9/1990 | Fenz et al. | 104/204 |
| 5,257,871 | 11/1993 | Zona et al. | 105/150 |
| 5,325,788 | 7/1994 | Strickland et al. | 104/119 |
| 5,524,548 | 6/1996 | Fox | 104/89 |

FOREIGN PATENT DOCUMENTS

| | | | |
|---|---|---|---|
| 0150701 | 8/1985 | European Pat. Off. . | |
| 0174701 | 3/1986 | European Pat. Off. . | |
| 0200640 | 11/1986 | European Pat. Off. . | |
| 0247005 | 11/1987 | European Pat. Off. . | |
| 0272782 | 6/1988 | European Pat. Off. . | |
| 2251506 | 4/1974 | Germany | 105/153 |

OTHER PUBLICATIONS

Eggenstein, F., Pater, H.-G. and Wetzel, E., "Elektrohängebahnen Technik und Entwicklung", f & h-fördern und heben 32 (1982), No. 11, pp. 863-866.

*Primary Examiner*—S. Joseph Morano
*Attorney, Agent, or Firm*—Dilworth & Barrese

[57] ABSTRACT

The invention relates to a traveling carriage moveable on a guide rod (14), wherein a traveling body (10) of the traveling carriage partially embraces the guide rod (14) with a gap opening remaining on one side, the gap opening being formed by a fixed projection (16) and a moveable projection (18) and, in the closed and locked operating condition, being smaller than the smallest cross section of the guide rod (14) which can be taken into consideration and, in the opened and unlocked removal condition, being larger than the largest cross section of the guide rod (14) which can be taken into consideration. This traveling carriage serves, for example, to mount a spotlight in a recording studio.

22 Claims, 3 Drawing Sheets

TRAVELING CARRIAGE

BACKGROUND OF THE INVENTION

The invention relates to a traveling carriage which is moveable on a guide rod, the guide rod preferably being a tube with a circular cross section.

For example, such traveling carriages are used to mount spotlights in film recording studios, guide rods of different cross sections being used for the traveling carriage. For such traveling carriages, it must be ensured that the traveling carriage cannot fall down from its elevated position in the recording studio but that is can otherwise still be easily and safely removed from the guide rod.

SUMMARY OF THE INVENTION

To solve this problem, a traveling carriage is proposed as defined herein.

This traveling carriage allows the use of guide rods of differently sized cross sections without the risk ensuing that the traveling carriage unintentionally falls off the guide rod from the elevated position. It is possible in a simple manner on account of the moveable projection to adjust the opening gap in the operative condition in such a manner that the traveling carriage cannot jump off the guide rod (not even in the case of breakage of the traveling rollers) when the guide rod has the smallest cross section which can be considered for the intended use. On the other hand, however, in the opened state, the traveling carriage can also be removed from the guide rod without effort in the case of the largest cross section which can be taken into consideration.

Preferably, the moveable projection is a component of a pivoting part which can be pivoted about a pivoting axis on the traveling body out of the closed and locked condition into the opened and unlocked condition for removal and vice versa. Therefore, the opening operation can ensue by means of a simple pivoting movement.

With regard to a particularly simple embodiment which functions well, a locking member is arranged on the pivoting part to be capable of movement against the force of a spring in such a manner that the spring presses the locking member in the direction of a locking engagement and in the opened and unlocked removal position, presses it against a holding stop. A locking recess for the locking member and an end stop for the locking member in the completely open position of the pivoting part is formed on the traveling body, there being a cam arranged in front of the locking recess against which the locking member abuts in the locking movement of the pivoting part and over which it is guided against the force of the spring into the annular recess. Thus, the locking can take place by a simple pivoting movement in the manner of a snap-in locking.

The centre of gravity of the pivoting part preferably lies outside the axis of rotation to the extent that the pivoting part automatically swings under the force of gravity into the opened position after unlocking and is held there in an end position. On account of this, only a simple release of the lock is necessary so that the pivoting part can automatically swing into its open position when the traveling carriage is on the guide rod. This releasing operation can therefore also be carried out in a simple manner when the traveling carriage is at a greater height.

According to an advantageous embodiment, the locking member is a locking bar which engages in two locking recesses arranged at a distance from one another, the locking bar being freely accessible between the locking recesses so that the unlocking step can ensue by way of a simple pushing movement and, as previously explained, the pivoting part can then automatically swing into the opened position.

The guide rod is preferably a tube with a circular cross section. However, the guide rod can also be a square tube with an upper longitudinal edge (FIG. 6).

According to an advantageous embodiment, a brake is arranged on the pivoting part and lies against the guide rod in the operative position. In this manner, the traveling carriage can be positioned at any desirable location on the guide rod. Additionally, the traveling carriage is prevented from beginning to move itself when there is a gradient in the guide rod.

The brake is designed to be releasable so that the position of the traveling carriage on the guide rod can also be changed in a simple manner in terms of the position of elevation. Additionally, it is also possible in this manner to release the brake when the pivoting part is swung into the open position. This simplifies the removal of the traveling carriage from the guide rod. Since the brake is arranged on the pivoting part, the brake simultaneously moves away when swinging the pivoting part out of its effective area. In principle, it is possible for the brake to remain in its braking position during the pivoting step. However, when the brake is released, the swinging back of the pivoting part into the closed position is simplified because the brake cannot then hinder this closing procedure by abutting against the guide rod during the closing procedure.

BRIEF DESCRIPTION OF THE DRAWINGS

The invention is described in more detail in the following with reference to an exemplary embodiment purely schematically illustrated in the drawings, in which.

DESCRIPTION OF THE PREFERRED EMBODIMENTS

Figure 2:
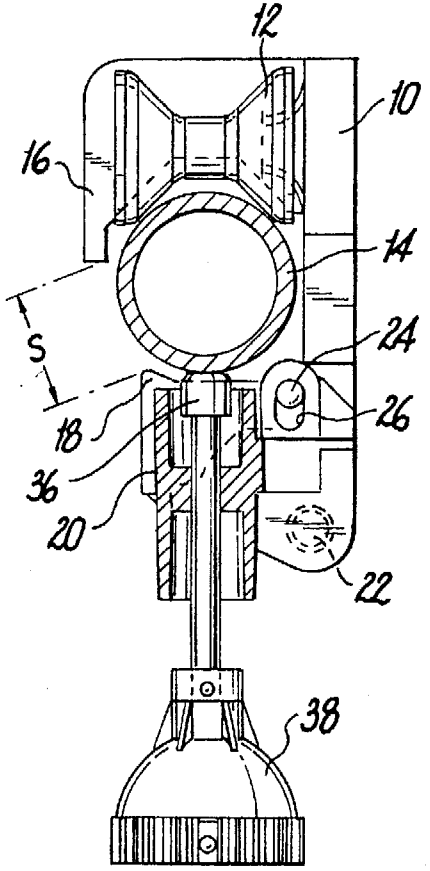
FIG. 2 shows a view according to FIG. 1, but in connection with a traveling tube with the largest cross section which can be taken into consideration.
Figure 1:
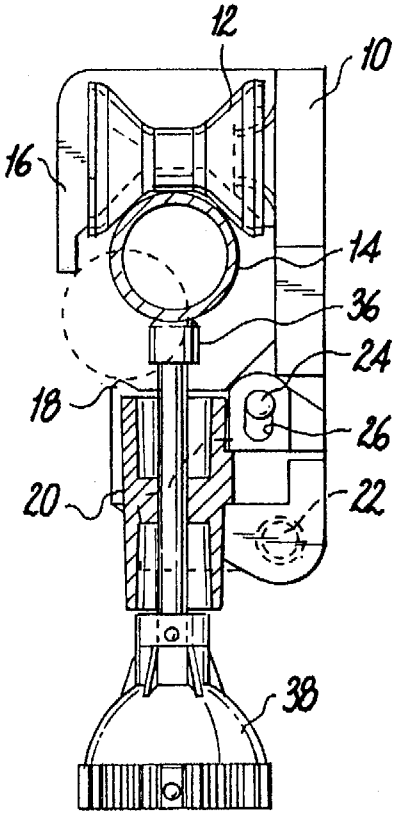
FIG. 1 shows a partially sectioned front view of a traveling carriage which runs on a tube with the smallest cross section which can be considered.
Figure 5:
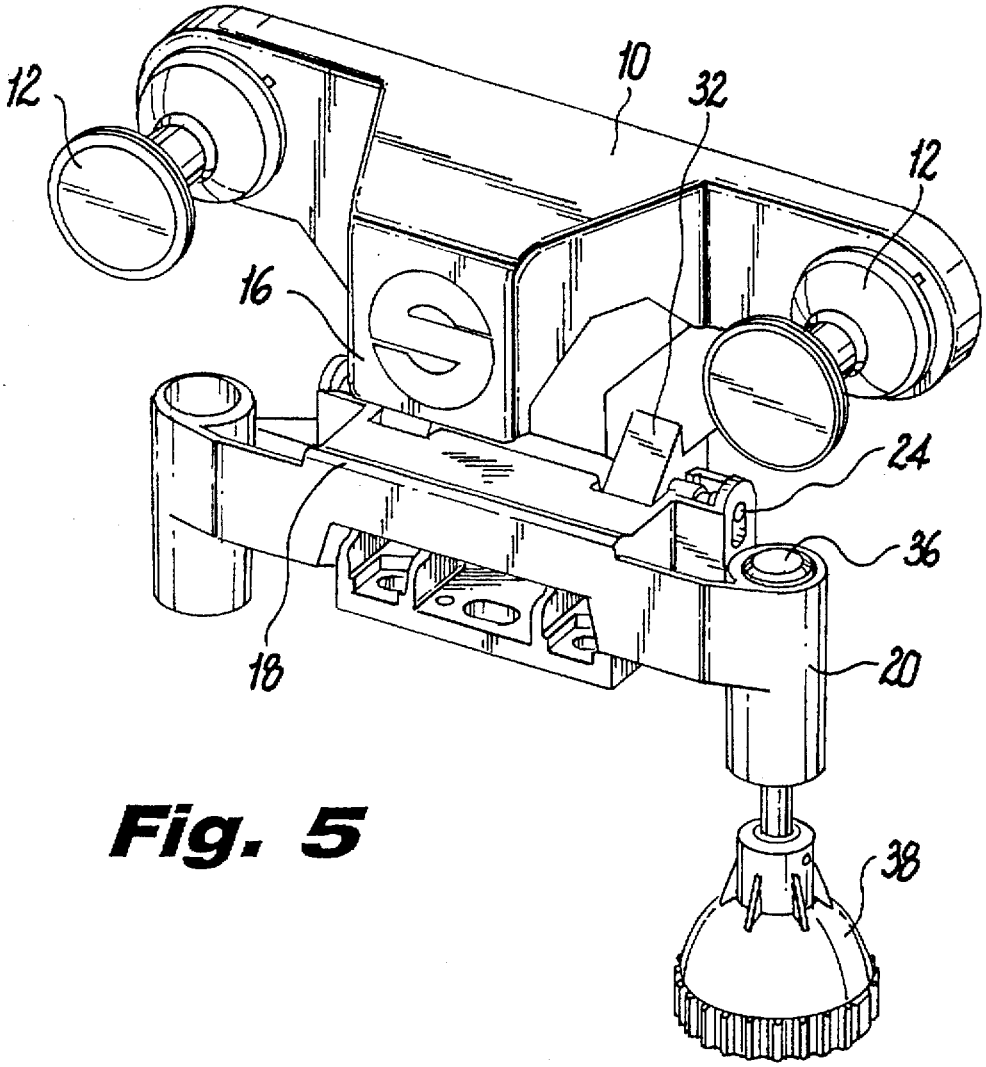
FIG. 5 shows a perspective view of the traveling carriage for better visual understanding.
Figure 6:
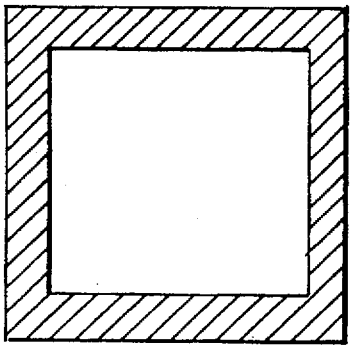
FIG. 6 shows a sectional view of an alternative embodiment of the guide tube.

The traveling carriage illustrated in the drawings has a traveling body 10 in which two traveling rollers 12 are mounted, as can best be seen in FIG. 5. The traveling body 10 travels via the traveling rollers 12 on a guide tube 14 with a circular cross section. The guide rod with the smallest cross section which can be taken into consideration is shown in FIG. 1 (diameter of 37 mm). The guide tube which has the largest cross section that can be taken into consideration is shown in FIG. 2 (diameter 52 mm). (These dimension values are mentioned purely by way of example).

The traveling body 10 partially embraces the guide tube 14 with the gripping projection 16 located between both of the traveling rollers, which is formed as a fixed projection, and a moveable projection 18 to form a gap opening S (FIG. 2).

In the closed position according to FIG. 1, the gap opening S is dimensioned such that the guide tube 14 cannot pass through this, as indicated with the illustration in dashes of the guide tube. This applies even more to the guide tube 14 of FIG. 2 since this has a larger diameter.

The moveable projection 18 is a component of a pivoting part 20 which is pivotably supported on a rotation axis 22 of the traveling body 10. An elongated locking bar 24 is located in this pivoting part and is arranged to be capable of movement into oblong holes arranged at a distance from one another, and in fact under the effect of a compression spring 28 as shown in FIG. 4.

Two locking recesses 30 (FIG. 3) are located on the traveling body 10 and a cam 32 is arranged respectively in front of each of these. At a distance to this there is an end stop 34 on the traveling body 10 against which the locking bar 24 comes to lie as shown in the illustration in FIG. 3.

Figure 3:
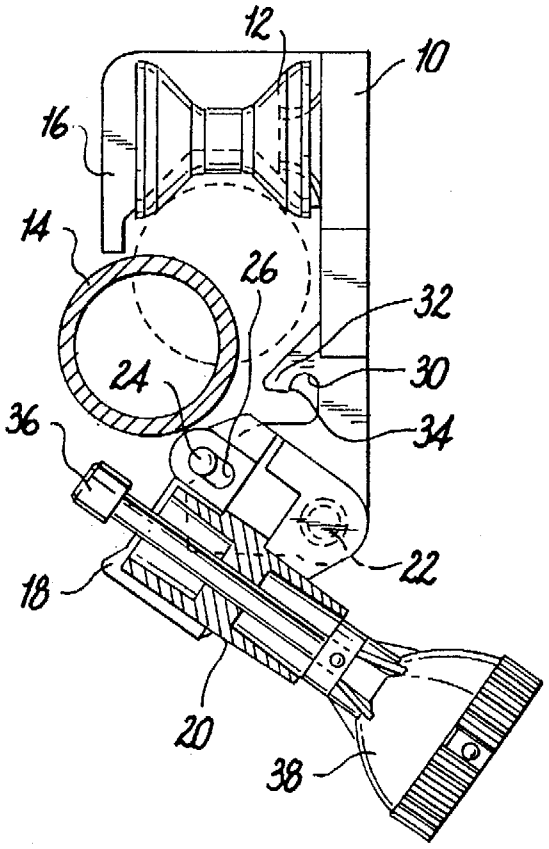
FIG. 3 shows the illustration of the traveling carriage according to FIG. 2 in the open position in which the traveling carriage can be removed from the guide rod.
Figure 4:
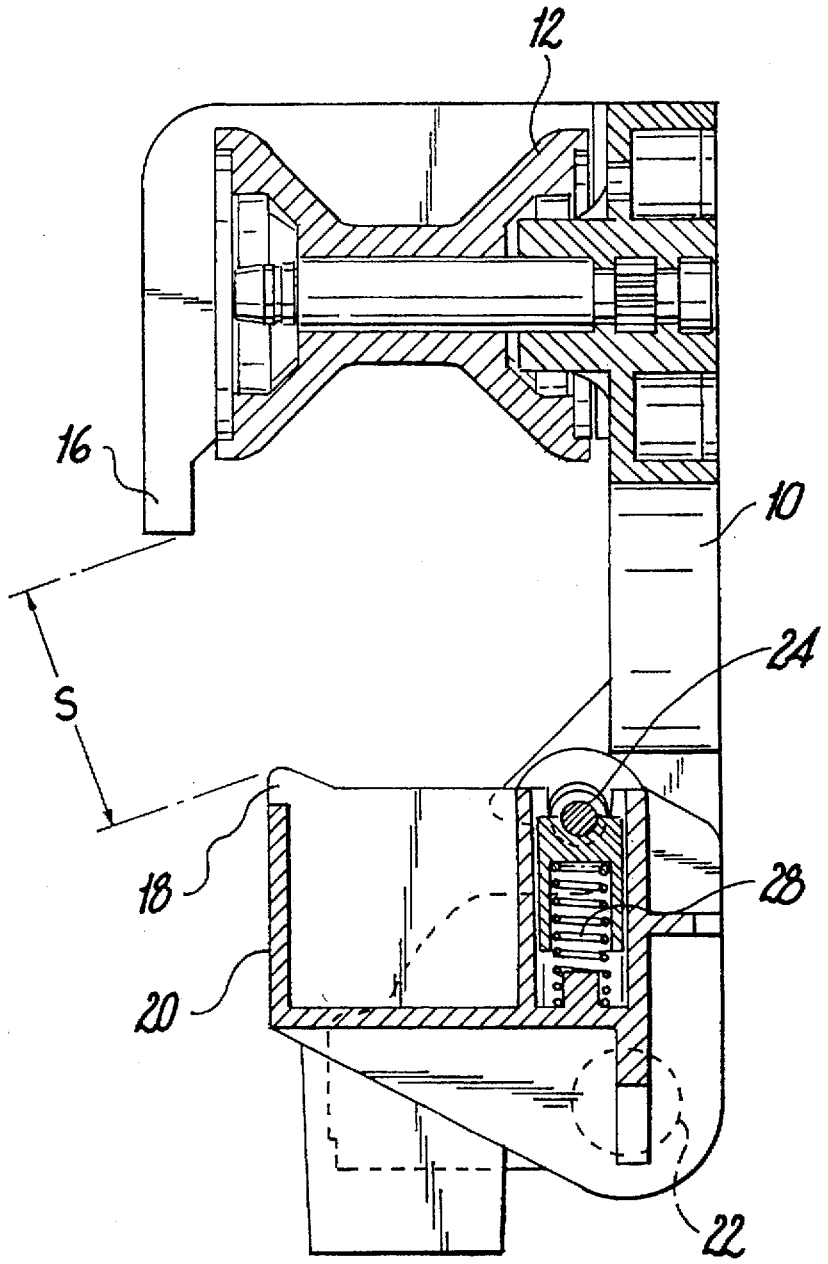
FIG. 4 shows a sectional view of the traveling carriage in the closed position without the guide tube.

The pivoting part 20 is rotatable between a locked operative position shown in FIG. 1, FIG. 2 and FIG. 4 and an open position shown in FIG. 3. In this open position according to FIG. 3, the gap opening is large enough to be able to remove the traveling carriage from the guide tube 14 through this opening.

The locking bar 24 is exposed between the two annularly spaced locking recesses 30 so that the locking bar is easily accessible for actuation. The centre of gravity of the pivoting part 20 lies to the left in the drawing outside the axis of rotation 22 so that after unlocking of the locking bar 24 out of the locking recesses 30, the pivoting part 20 automatically swings out of the locked position under the force of gravity into the position illustrated in FIG. 3. When the pivoting part 20 is moved out of this position into the locked position, the compression spring 28 initially presses the locking bar 24 against the end of the oblong hole 26. When the locking bar 24 abuts the cam 32 during the pivoting movement into the locking position, the locking bar 24 is moved against the force of the spring 28 and can then snap into the locking recesses 30. For unlocking, the exposed part of the locking bar 24 is directly acted upon so that this is pressed out of the locking recess against the force of the spring 28. As soon as the locking bar 24 has been freed from the locking recesses 30, the pivoting part 20 swings into the open position as illustrated in FIG. 3.

In the pivoting part 20, there is a brake 36 which is not shown in FIG. 4 but abuts from below against the guide rod 14 in accordance with FIG. 1 and FIG. 2 so that the respective position of the traveling carriage along the guide rod 14 is capable of being fixed, and in the case of the traveling tube 14, possibly having an inclined position. Additionally, the traveling carriage can be prevented from moving out of the desired position.

The brake 36 is pressed against the guide rod 14 by a spring, not illustrated in the drawings so that a force-lock in the form of a friction-lock is provided. The brake can be released from the ground against the force of a spring by means of a bell-shaped member 38 when the traveling carriage is located at a higher elevated position. The actuation ensues by means of a manipulation rod. In this case, the bell-shaped member simplifies the engagement of the actuating member to release the brake by means of the manipulating rod.

It is not absolutely necessary that the brake is released when the pivoting part is pivoted out of the locked position according to FIG. 2 into the open position according to FIG. 3. However, it is advantageous to hold the brake in the released state (pulled back state) when the pivoting part 20 is pivoted into the locked position. This is particularly the case when the larger guide rod 14 is used, as the brake 36 then otherwise slides during the locking operation along the surface of the guide rod 14 and must be moved against the spring. This can hinder the snap-in locking procedure.

We claim:

1. A traveling carriage movable on a guide rod (14) and comprising a traveling body (10) which partially embraces the guide rod (14) while leaving a gap opening (S) on one side, the gap opening (S) being formed by a fixed gripping projection (16) and a movable projection (18), and in a closed and locked operating condition, being smaller than a smallest cross section of the guide rod (14) which can be taken into consideration, and in an opened and unlocked removal condition, being larger than a largest cross section of the guide rod (14) which can be taken into consideration, characterized in that the movable projection (18) is a component of a pivoting part (20) which can be pivoted about an axis of rotation (22) on the traveling body (10) out of the closed and locked operating condition into the opened and unlocked removal condition and vice versa, a locking member (24) is arranged on the pivoting part (20) to be capable of being moved against the force of a spring (28) in such a manner that the spring (28) presses the locking member (24) in the direction of a locking engagement against a holding stop (34), a locking recess (30) for the locking member (24) and the holding stop (34) for the locking member (24) are formed on the traveling body (10), and the locking recess (30) having a cam (32) arranged in front thereof against which the locking member (24) abuts during the closing pivoting movement of the pivoting part (20) and over which the locking member (24) is guided into the locking recess (30) against the force of the spring (28).

2. A traveling carriage according to claim 1, characterized in that the center of gravity of the pivoting part (20) lies outside the axis of rotation (22) to such an extent that the pivoting part (20) automatically swings under the force of gravity into the opened position after unlocking.

3. A traveling carriage according to claim 2, characterized in that an additional locking recesses (30) is provided and the locking member is a locking bar (24) which engages in the two spaced locking recesses (30) and between which locking recesses (30) the bar (24) is freely accessible.

4. A traveling carriage according to claim 3, characterized in that a brake (36) is arranged on the pivoting part (20) and lies against the guide rod (14) in its operative position.

5. A traveling carriage according to claim 2, characterized in that a brake (36) is arranged on the pivoting part (20) and lies against the guide rod (14) in its operative position.

6. A traveling carriage according to claim 5, characterized in that the brake is capable of being released in the operative position of the traveling carriage.

7. A traveling carriage according to claim 1, characterized in that an additional locking recess (30) is provided and the locking member is a locking bar (24) which engages in the two spaced locking recesses (30) and between which locking recesses (30) the bar (24) is freely accessible.

8. A traveling carriage according to claim 7, characterized in that a brake (36) is arranged on the pivoting part (20) and lies against the guide rod (14) in its operative position.

9. A traveling carriage according to claim 8, characterized in that the brake is capable of being released in the operative position of the traveling carriage.

10. A traveling carriage according to claim 1, characterized in that the guide rod is a tube (14) with a circular cross section.

11. A traveling carriage according to claim 1, characterized in that the guide rod is a square tube with an upper longitudinal edge.

12. A traveling carriage according to claim 1, characterized in that a brake (36) is arranged on the pivoting part (20) and lies against the guide rod (14) in its operative position.

13. A traveling carriage according to claim 12, characterized in that the brake is capable of being released in the operative position of the traveling carriage.

14. A traveling carriage according to claim 12, characterized in that the brake (36) applies a force on a biased member and lies with a braking surface against the guide rod (14).

15. A traveling carriage movable on a guide rod (14) and comprising a traveling body (10) which partially embraces the guide rod (14) while leaving a gap opening (S) on one side, the gap opening (S) being formed by a fixed gripping projection (16) and a movable projection (18), and in a closed and locked operation condition, being smaller than a smallest cross section of the guide rod (14) which can be taken into consideration, and in an opened and unlocked removal condition, being larger than a largest cross section of the guide rod (14) which can be taken into consideration, characterized in that the movable projection (18) is a component of a pivoting part (20) which can be pivoted about an axis of rotation (22) on the traveling body (10) out of the closed and locked operating condition into the opened and unlocked removal condition and vice versa, and a brake (36) is arranged on the pivoting part (20) and lies against the guide rod (14) in its operative position.

16. A traveling carriage according to claim 15, characterized in that the brake is capable of being released in the operative position of the traveling carriage.

17. A traveling carriage according to claim 16, characterized in that the brake (36) applies a force on a biased member and lies with a braking surface against the guide rod (14).

18. A traveling carriage according to claim 15, characterized in that the brake (36) applies a force on a biased member and lies with a braking surface against the guide rod (14).

19. A traveling carriage movable on a guide rod (14) and comprising a traveling body (10) which partially embraces the guide rod (14) while leaving a gap opening (S) on one side, the gap opening (S) being formed by a fixed gripping projection (16) and a movable projection (18), and in a closed and licked operating condition, being smaller than a smallest cross section of the guide rod (14) which can be taken into consideration, and in an opened and unlocked removal condition, being larger than a largest cross section of the guide rod (14) which can be taken into consideration, and additionally comprising means for automatically maintaining the movable projection (18) in place in the closed and locked operating condition when the movable projection (18) is moved into the closed and locked operating position, wherein said means comprise self-locking or snap-in locking means when the movable projection (18) is moved into the closed and locked operating position.

20. A traveling carriage according to claim 19, characterized in that the movable projection (18) is a component of a pivoting part (20) which can be pivoted about an axis of rotation (22) on the traveling body (10) out of the closed and locked operating condition into the opened and unlocked removal condition and vice versa.

21. A traveling carriage according to claim 19, wherein said means comprise a locking member (24) coupled to the movable part (18) and a holding stop (34) mounted upon the traveling body (10) to maintain the locking member (24) in the closed and locked operating position.

22. A traveling carriage movable on a guide rod (14) and comprising a traveling body (10) which partially embraces the guide rod (14) while leaving a gap opening (S) on one side, the gap opening (S) being formed by a fixed gripping projection (16) and a movable projection (18), and in a closed and locked operating condition, being smaller than a smallest cross section of the guide rod (14) which can be taken into consideration, and in an opened and unlocked removal condition, being larger than a largest cross section of the guide rod (14) which can be taken into consideration, characterized in that the movable projection (18) is a component of a pivoting part (20) which can be pivoted about an axis of rotation (22) on the traveling body (10) out of the closed and locked operating condition into the opened and unlocked removal condition and vice versa, and the center of gravity of the pivoting part (20) lies outside the axis of rotation (22) to such an extent that the pivoting part (20) automatically swings under the force of gravity into the opened position after unlocking.

* * * * *